US006253552B1

(12) United States Patent
Peletz, Jr.

(10) Patent No.: US 6,253,552 B1
(45) Date of Patent: Jul. 3, 2001

(54) FLUIDIZED BED FOR KALINA CYCLE POWER GENERATION SYSTEM

(75) Inventor: Lawrence J. Peletz, Jr., Erie, PA (US)

(73) Assignee: ABB Combustion Engineering, Windsor, CT (US)

( * ) Notice: Subject to any disclaimer, the term of this patent is extended or adjusted under 35 U.S.C. 154(b) by 0 days.

(21) Appl. No.: 09/231,169

(22) Filed: Jan. 13, 1999

(51) Int. Cl.[7] ..... F01K 25/06

(52) U.S. Cl. ..... 60/649; 60/653

(58) Field of Search ..... 60/649, 653, 679

(56) References Cited

U.S. PATENT DOCUMENTS

| | | | | |
|---|---|---|---|---|
| 2,830,440 | * | 4/1958 | Durham | 60/653 |
| 2,867,983 | * | 1/1959 | Amacost | 60/653 |
| 3,169,374 | * | 2/1965 | Powell et al. | 60/653 X |
| 4,442,797 | | 4/1984 | Strohmeyer, Jr. | 122/4 D |
| 4,489,563 | | 12/1984 | Kalina | 60/673 |
| 4,732,005 | | 3/1988 | Kalina | 60/673 |
| 4,838,027 | * | 6/1989 | Rosado et al. | 60/649 X |
| 4,982,568 | | 1/1991 | Kalina | 60/649 |
| 5,029,444 | | 7/1991 | Kalina | 60/673 |
| 5,095,708 | | 3/1992 | Kalina | 60/673 |
| 5,372,007 | * | 12/1994 | Garbo | 60/649 |
| 5,440,882 | | 8/1995 | Kalina | 60/641.2 |
| 5,442,919 | * | 8/1995 | Wilhelm | 60/653 X |
| 5,450,821 | | 9/1995 | Kalina | 122/1 |
| 5,572,871 | | 11/1996 | Kalina | 60/649 |
| 5,588,298 | | 12/1996 | Kalina et al. | 60/673 |

FOREIGN PATENT DOCUMENTS

| | | | |
|---|---|---|---|
| 0 846 748 A1 | 10/1998 | (EP) | C10J/3/66 |

OTHER PUBLICATIONS

Kalina Cycles for Efficient Direct Fired Application,–Alexander I. Kalina, Yakov Lerner, Richard I. Pelletier, Exergy, Inc. , Lawrence J. Peletz, Jr. ABB CE systems, Combustion engineering, Inc., –7 pgs. (No Date).

Kalina Cycle Looks Good for Combined Cycle Generation–Dr. James C. Corman, Dr. Robert W. Bjorge, GE Power Systems, Dr. Alexander Kalina, Exergy, Inc., Jul., 1995–3 pgs.

Power Perspective, The Kalina Cycle–More Eelctricity From Each BTU of Fuel–1995–3 pgs.

(List continued on next page.)

*Primary Examiner*—Hoang Nguyen
(74) *Attorney, Agent, or Firm*—Lalos & Keegan; Alfred Stadnicki

(57) ABSTRACT

An apparatus for heating a multicomponent working fluid includes a circulating fluidized bed configured to combust a collection of solid particles producing flue gases carrying particulate matter. Heat from the flue gases is transferred to a multicomponent working fluid contained within a plurality of first fluid tubes forming an enclosure for containing and directing a flow of the flue gases. The enclosure may also contain additional tubes forming a superheater. A separator receives the flue gases from the enclosure and separates the particulate matter therefrom expelling a first portion of the flue gases substantially without the separated particulate matter and a second portion of the flue gases containing the particulate matter. A heat exchanger receives the second portion of the flue gases provided as an output from the separator. An adjustable flow controller regulates the flow from the separator of the second portion of the flue gases to the heat exchanger and to the enclosure. The heat exchanger includes a third plurality of tubes which transfer heat from the second portion of the flue gases from the separator to the multicomponent working fluid and may also include a fourth plurality of tubes containing a single component working fluid.

42 Claims, 7 Drawing Sheets

OTHER PUBLICATIONS

A Gas Turbine–Aqua Ammonia Combined Power Cycle–Irby Hicks, The Thermosorb Company–Mar. 25, 1996–6 pgs.

Understanding the Kalina Cycle Fundamentals–H.A. Mlcak, P.E., ABB Lummus Crest–12 pgs. (No Date).

Direct–Fired Kalina Cycle: Overview–ABB–1994–13 pgs.

Kalina Cycle System Advancements for Direct Fired Power Generation, Michael J. Davidson, Lawrence J. Peletz, ABB Combustion Engineering,–9 pgs (No Date).

Kalina Cycles and System for Direct–Fired Power Plants, A.I. Kalina, Exergy, Inc., AES–vol. 25/HTD–vol. 191–7 pgs (No Date).

N G Zervos, Stone & Webster Engineering Corporation "Updated Design and Economics of the Kalina Cycle for Solid Fuel Applications", pp. 179–184, 1992.

N G Zervos, Stone & Webster Engineering Corp., H M Leibowitz, Exergy Inc., and K Robinson, Rockwell International corp. "Innovative Kalina Cycle Promises High Efficiency", Developments to Watch, Apr., 1992, New York, US, pp. 177–179.

* cited by examiner

FLUIDIZED BED FOR KALINA CYCLE POWER GENERATION SYSTEM

CROSS-REFERENCE TO RELATED APPLICATIONS

The present application relates to pending U.S. patent application Ser. No. 09/231,165, filed Jan. 13, 1999, for "TECHNIQUE FOR CONTROLLING REGENERATIVE SYSTEM CONDENSATION LEVEL DUE TO CHANGING CONDITIONS IN A KALINA CYCLE POWER GENERATION SYSTEM"; U.S. patent application Ser. No. 09/231,171, filed Jan. 13, 1999, for "TECHNIQUE FOR BALANCING REGENERATIVE REQUIREMENTS DUE TO PRESSURE CHANGES IN A KALINA CYCLE POWER GENERATION SYSTEM"; U.S. patent application Ser. No. 09/229,364, filed Jan. 12, 1999, for "TECHNIQUE FOR CONTROLLING SUPERHEATED VAPOR REQUIREMENTS DUE TO VARYING CONDITIONS IN A KALINA CYCLE POWER GENERATION SYSTEM"; U.S. patent application Ser. No. 09/231,166, filed Jan. 13, 1999, for "TECHNIQUE FOR MAINTAINING PROPER DRUM LIQUID LEVEL IN A KALINA CYCLE POWER GENERATION SYSTEM"; U.S. patent application Ser. No. 09/229,629, filed Jan. 13, 1999, for "TECHNIQUE FOR CONTROLLING DCSS CONDENSATE LEVELS IN A KALINA CYCLE POWER GENERATION SYSTEM"; U.S. patent application Ser. No. 09/229,630, filed Jan. 13, 1999, for "TECHNIQUE FOR MAINTAINING PROPER FLOW IN PARALLEL HEAT EXCHANGERS IN A KALINA CYCLE POWER GENERATION SYSTEM"; U.S. patent application Ser. No. 09/229,631, filed Jan. 13, 1999; U.S. patent application Ser. No. 09/231,164, filed Jan. 13, 1999, for "WASTE HEAT KALINA CYCLE POWER GENERATION SYSTEM"; U.S. patent application Ser. No. 09/229,366, filed Jan. 13, 1999, for "MATERIAL SELECTION AND CONDITIONING TO AVOID BRITTLENESS CAUSED BY NITRIDING"; U.S. patent application Ser. No. 09/231,168, filed Jan. 13, 1999, for "REFURBISHING CONVENTIONAL POWER PLANTS FOR KALINA CYCLE OPERATION"; U.S. patent application Ser. No. 09/231,170, filed Jan. 13, 1999, for "STARTUP TECHNIQUE USING MULTIMODE OPERATION IN A KALINA CYCLE POWER GENERATION SYSTEM"; U.S. patent application Ser. No. 09/231,163, filed Jan. 13, 1999, for "TECHNIQUE FOR COOLING FURNACE WALLS IN A MULTICOMPONENT WORKING FLUID POWER GENERATION SYSTEM; U.S. patent application Ser. No. 09/229,632, filed Jan. 13, 1999, for "BLOWDOWN RECOVERY SYSTEM IN A KALINA CYCLE POWER GENERATION SYSTEM"; U.S. patent application Ser. No. 09/229,368, filed Jan. 13, 1999, for "REGENERATIVE SUBSYSTEM CONTROL IN A KALINA CYCLE POWER GENERATION SYSTEM"; U.S. patent application Ser. No. 09/229,363, filed Jan. 13, 1999, for "DISTILLATION AND CONDENSATION SUBSYSTEM (DCSS) CONTROL IN A KALINA CYCLE POWER GENERATION SYSTEM"; U.S. patent application Ser. No. 09/229,365, filed Jan. 13, 1999, for "VAPOR TEMPERATURE CONTROL IN A KALINA CYCLE POWER GENERATION SYSTEM"; U.S. patent application Ser. No. 09/229,367, filed Jan. 13, 1999, for "A HYBRID DUAL CYCLE VAPOR GENERATOR"; U.S. patent application Ser. No. 09/231,167, filed Jan. 13, 1999, for "TECHNIQUE FOR RECOVERING WASTE HEAT USING A BINARY WORKING FLUID".

FIELD OF THE INVENTION

The present invention is in the field of power generation systems. In particular, the present invention is related to a circulating fluidized bed vapor generator utilized in a multicomponent fluid power cycle.

BACKGROUND OF THE INVENTION

In recent years, industrial and utility concerns with deregulation and operational costs have strengthened demands for increased power plant efficiency. The Rankine cycle power plant, which typically utilizes water as the working fluid, has been the mainstay for the utility and industrial power industry for the last 150 years. In a Rankine cycle power plant, heat energy is converted into electrical energy by heating a working fluid flowing through tubular walls, commonly referred to as waterwalls, to form a vapor, e.g., turning water into steam. Typically, the vapor will be superheated to form a high pressure vapor, e.g., superheated steam. The high pressure vapor is used to power a turbine/generator to generate electricity.

Conventional Rankine cycle power generation systems can be of various types, including direct-fired, fluidized bed and waste-heat type systems. In direct fired and fluidized bed type systems, combustion process heat is generated by burning fuel to heat the combustion air which in turn heats the working fluid circulating through the systems' waterwalls. In direct-fired Rankine cycle power generation systems the fuel, commonly pulverized-coal, gas or oil, is ignited in burners supported by the waterwalls. In bubbling fluidized bed Rankine cycle power generation systems pulverized-coal is ignited in a bed located at the base of the boiler to generate combustion process heat. Waste-heat Rankine cycle power generation systems rely on heat generated in another process, e.g., incineration, for process heat to vaporize, and if desired superheat, the working fluid. Due to the metallurgical limitations, the highest temperature of the superheated steam does not normally exceed 1050° F. (566° C.). However, in some "aggressive" designs, this temperature can be as high as 1100° F. (593° C.).

Over the years, efficiency gains in Rankine cycle power systems have been achieved through technological improvements which have allowed working fluid temperatures and pressures to increase and exhaust gas temperatures and pressures to decrease. An important factor in the efficiency of the heat transfer is the average temperature of the working fluid during the transfer of heat from the heat source. If the temperature of the working fluid is significantly lower than the temperature of the available heat source, the efficiency of the cycle will be significantly reduced. This effect, to some extent, explains the difficulty in achieving further gains in efficiency in conventional, Rankine cycle-based, power plants.

In view of the above, a departure from the Rankine cycle has recently been proposed. The proposed new cycle, commonly referred to as the Kalina cycle, attempts to exploit the additional degree of freedom available when using a binary fluid, more particularly an ammonia/water mixture, as the working fluid. The Kalina cycle is described in the paper entitled: "Kalina Cycle System Advancements for Direct Fired Power Generation", co-authored by Michael J. Davidson and Lawrence J. Peletz, Jr., and published by Combustion Engineering, of Windsor, Connecticut. Efficiency gains are obtained in the Kalina cycle plant by reducing the energy losses during the conversion of heat energy into electrical output.

Kalina Cycle Power Generation System

A simplified conventional direct-fired Kalina cycle power generation system is illustrated in FIG. 1 of the drawings. Kalina cycle power plants are characterized by three basic system elements, the Distillation and Condensation Subsystem (DCSS) 100, the Vapor Subsystem (VSS) 110 which includes the boiler 142, superheater 144 and recuperative heat exchanger (RHE) 140, and the turbine/generator subsystem (TGSS) 130. The DCSS 100 and RHE 140 are sometimes jointly referred to as the Regenerative Subsystem (RSS) 150. The boiler 142 is formed of tubular walls 142*a* and the superheater 144 is formed of tubular walls and/or banks of tubular tubes 144*a*. A heat source 120 provides process heat 121. A portion 123 of the process heat 121 is used to vaporize the working fluid in the boiler 142. Another portion 122 of the process heat 121 is used to superheat the vaporized working fluid in the superheater 144.

During normal operation of the Kalina cycle power system of FIG. 1, the ammonia/water working fluid is fed to the boiler 142 from the RHE 140 by liquid stream FS 5 and from the DCSS 100 by liquid stream FS 7. The working fluid is vaporized, i.e., boiled, in the tubular walls 142*a* of the boiler 142. The FS rich working fluid stream 20 from the DCSS 100 is also vaporized in the heat exchanger(s) of the RHE 140.

In one implementation, the vaporized working fluid from the boiler 142 along with the vaporized working fluid FS 9 from the RHE 140, is further heated in the tubular walls/fluid tube bank 144*a* of the superheater 144. The superheated vapor from the superheater 144 is directed to and powers the TGSS 130 as FS vapor 40 so that electrical power 131 is generated to meet the load requirement. In an alternative implementation, the RHE 140 not only vaporizes but also superheats the rich stream FS 20. In such a case, the superheated vapor flow FS 9' from the RHE 140 is combined with the superheated vapor from the superheater 144 to form FS vapor flow 40 to the TGSS 130.

Expanded working fluid FS extraction 11 egresses from the TGSS 130, e.g., from a low pressure (LP) turbine (not shown) within the TGSS 130, and is directed to the DCSS 100. This expanded working fluid is, in part, condensed in the DCSS 100. Working fluid condensed in the DCSS 100, as described above, forms feed fluid FS 7, which is fed to the boiler 142. Another key feature of the DCSS 100 is the separation of the working fluid egressing from TGSS 130 into ammonia rich and ammonia lean streams for use by the VSS 110. In this regard, the DCSS 100 separates the expanded working fluid into an ammonia rich working fluid flow FS rich 20 and an ammonia lean working fluid flow FS lean 30. Waste heat 101 from the DCSS 100 is dumped to a heat sink, such as a river or pond.

The rich and lean flows FS 20, FS 30, respectively, are fed to the RHE 140. Another somewhat less expanded hot working fluid FS extraction 10 egresses from the TGSS 130, e.g., from a high pressure (HP) turbine (not shown) within the TGSS 130, and is directed to the RHE 140. Heat is transferred from the expanded working fluid FS extraction 10 and the working fluid FS lean stream 30 to the rich working fluid flow FS rich 20, to thereby vaporize the rich flow FS 20 and condense, at least in part, the expanded working fluid FS extraction 10 and FS lean working fluid flow 30, in the RHE 140. As discussed above, the vaporized rich flow FS 20 is fed to either the superheater 144, along with vaporized feed fluid from the boiler 142, or is combined with the superheated working fluid from the superheater 142 and fed directly to the TGSS 130. The condensed expanded working fluid from the RHE 140 forms part of the feed flow, i.e., flow FS 5, to the boiler 142, as has been previously described.

FIG. 2 details a portion of the RHE 140 of VSS 110 of FIG. 1. As shown, the RHE 140 receives ammonia-rich, cold high pressure stream FS rich 20 from DCSS 100. Stream FS rich 20 is heated by ammonia-lean hot low pressure stream FS 3010. The stream FS 3010 is formed by combining the somewhat lean hot low pressure FS extraction stream 10 from TGSS 130 with the lean hot low pressure stream FS 30 from DCSS 100, these flows being combined such that stream FS 30 dilutes stream FS 10 resulting in a desired concentration of ammonia in stream FS 3010.

Heat energy 125, is transferred from stream FS 3010 to stream FS rich 20. As discussed above, this causes the transformation of stream FS 20 into a high pressure vapor stream FS 9 or the high pressure superheated vapor stream FS 9', depending on the pressure and concentration of the rich working fluid stream FS 20. This also causes the working fluid stream FS 3010 to be condensed and therefore serve as a liquid feed flow FS 5 to the boiler 142.

As previously indicated, in one implementation the vapor stream FS 9 along with the vapor output from boiler 142 forms the vapor input to the superheater 144, and the superheater 144 superheats the vapor stream to form superheated vapor stream 40 which is used to power TGSS 130. Alternatively, the superheated vapor steam FS 9' along with the superheated vapor output from the superheater 144 forms the superheated vapor stream FS 40 to the TGSS 130.

FIG. 3 illustrates exemplary heat transfer curves for heat exchanges occurring in the RHE 140 of FIG. 2. A typical Kalina cycle heat exchange is represented by curves 520 and 530. As shown, the temperature of the liquid binary working fluid FS 20 represented by curve 520 increases as a function of the distance of travel of the working fluid through the heat exchanger of the RHE 140 in a substantially linear manner. That is, the temperature of the working fluid continues to increase even during boiling as the working fluid travels through the heat exchanger of the RHE 140 shown in FIG. 2. At the same time, the temperature of the liquid working fluid FS 3010 represented by curve 530 decreases as a function of the distance of travel of this working fluid through the heat exchanger of the RHE 140 in a substantially linear manner. That is, as heat energy 125 is transferred from working fluid FS 3010 to the working fluid stream FS 20 as both fluid streams flow in opposed directions through the RHE 140 heat exchanger of FIG. 2, the binary working fluid FS 3010 loses heat and the binary working fluid stream FS 20 gains heat at substantially the same rate within the Kalina cycle heat exchangers of the RHE 140.

In contrast, a typical Rankine cycle heat exchange is represented by curve 510. As shown, the temperature of the water or water/steam mixture forming the working fluid represented by curve 510 increases as a function of the distance of travel of the working fluid through a heat exchanger of the type shown in FIG. 2 only after the working fluid has been fully evaporated, i.e., vaporized. The portion 511 of curve 510 represents the temperature of the water or water/steam mixture during boiling. As indicated, the temperature of the working fluid remains substantially constant until the boiling duty has been completed. That is, in a typical Rankine cycle, the temperature of the working fluid does not increase during boiling. Rather, as indicated by portion 512 of curve 510, it is only after full vaporization, i.e., full phase transformation, that the temperature of the working fluid in a typical Rankine cycle increases beyond the boiling point temperature of the working fluid, e.g., 212° F.

As will be noted, the temperature differential between the stream represented by curve 530, which transfers the heat energy, and the Rankine cycle stream represented by curve 510, which absorbs the heat energy, continues to increase during phase transformation. The differential becomes greatest just before complete vaporization of the working fluids. In contrast, the temperature differential between the stream represented by curve 530, and the Kalina cycle stream represented by curve 520, which absorbs the heat energy, remains relatively small, and substantially constant, during phase transformation. This further highlights the enhanced efficiency of Kalina cycle heat exchange in comparison to Rankine cycle heat exchange.

As indicated above, the transformation in the RHE 140 of the liquid or mixed liquid/vapor stream FS 20 to vapor or superheated vapor stream FS 9 or 9' is possible in the Kalina cycle because, the boiling point of rich cold high pressure stream FS 20 is substantially lower than that of lean hot low pressure stream FS 3010. This allows additional boiling, and in some implementations superheating, duty to be performed in the Kalina cycle RHE 140 and hence outside the boiler 142 and/or superheater 144. Hence, in the Kalina cycle, a greater portion of the process heat 121 can be used for superheating vaporized working fluid in the superheater 144, and less process heat 121 is required for boiling duty in the boiler 142. The net result is increased efficiency of the power generation system when compared to a conventional Rankine cycle type power generation system.

FIG. 4 further depicts the TGSS 130 of FIG. 1. As illustrated, the TGSS 130 in a Kalina cycle power generation system is driven by a high pressure superheated binary fluid vapor stream FS 40. Relatively lean hot low pressure stream FS extraction 10 is directed from, for instance the exhaust of an HP turbine (not shown) within the TGSS 130 to the RHE 140 as shown in FIGS. 1 and 2. A relatively lean cooler, even lower pressure flow FS extraction 11 is directed from, for instance, the exhaust of an LP turbine (not shown) within the TGSS 130 to the DCSS 100 as shown in FIG. 1. As has been discussed to some extent, both FS extraction flow 10 and FS extraction flow 11 retain enough heat to transfer energy to still cooler higher pressure streams in the DCSS 100 and RHE 140.

Problems with Design of Vapor Generator for Kalina Cycle

A crucial process in generating power for a Rankine cycle or a Kalina cycle, is the generation of heat and the transference of that heat to a working fluid. The working fluid is converted by the heat into a high pressure vapor that drives one or more vapor turbines. In a direct fired system, a single physical unit typically implements this process, i.e., the unit containing combustion components for generating heat, and heat transfer surfaces, such as the boiler, superheater and reheater, for converting that heat to a working vapor. This unit may be referred to by various names, including a "furnace" or a "vapor generator".

The design of a vapor generator for use in a Kalina cycle must take into consideration the thermodynamic properties of a Kalina cycle. It has been proposed to use a direct fired pulverized coal boiler with a Kalina cycle. For a pulverized coal fired unit, normal furnace gas temperatures are quite high in the range 2800° F.–3000° F. Due in part to the heat transfer characteristics of the binary mixture and the high heat fluxes in the furnace, the wall tubes in a Kalina cycle direct-fired pulverized coal furnace may experience a cooling problem. In a conventional Rankine cycle power generation plant furnace, the furnace envelope is cooled with the working fluid as the working fluid is transformed from a liquid to a vapor (evaporative duty). In contrast, in a conventional Kalina cycle power generation plant, a large part of the evaporative duty is done in the regenerative subsystem, and hence outside the furnace envelope. Accordingly, there is a relatively small amount of low temperature liquid available for cooling the furnace walls. With a reduced amount of evaporative duty available and the different properties of the ammonia/water mixture, acceptable metal temperatures of furnace tubes formed of conventional materials may be exceeded. It may be possible to reduce the temperature in the furnace walls of a direct fired pulverized coal unit by adding a number of parallel heating duties; however, this could be complicated and expensive.

OBJECTS OF THE INVENTION

Accordingly, it is an object of the present invention to provide a vapor generator which will overcome the above described problems and efficiently operate in a multicomponent fluid power cycle, such as a Kalina cycle.

It is a further object of the present invention to provide a technique for avoiding overheating of the furnace walls in a multicomponent fluid power cycle, such as a Kalina cycle.

It is a further object of the present invention to provide a lower temperature fired Kalina cycle vapor generating furnace.

Additional objects, advantages, and novel features of the present invention will become apparent to those skilled in the art from this disclosure, including the following detailed description, as well as by practice of the invention. While the invention is described below with reference to a preferred embodiment(s), it should be understood that the invention is not limited thereto. Those of ordinary skill in the art having access to the teachings herein will recognize additional implementations, modifications, and embodiments, as well as other fields of use, which are within the scope of the invention as disclosed and claimed herein and with respect to which the invention could be of significant utility.

SUMMARY OF THE INVENTION

According to the present invention, an apparatus for heating a multicomponent working fluid includes a circulating fluidized bed configured to combust a collection of solid particles producing flue gases. A first plurality of fluid tubes form an enclosure for containing and directing a flow of the flue gases. The first fluid tubes direct a flow of the multicomponent working fluid so that heat from the flue gases is transferred to the multicomponent working fluid. Preferably, the multicomponent working fluid is a mixture of ammonia and water and the apparatus operates in a Kalina power cycle.

In a further aspect of the present invention, the first plurality of fluid tubes are further configured such that the heat transferred from the multicomponent working fluid performs vaporizing and superheating of the multicomponent working fluid.

In another aspect of the present invention, the enclosure is formed proximate to the circulating fluidized bed for receiving the flue gases from the circulating fluidized bed.

In yet another aspect of the present invention, the enclosure further includes a second plurality of tubes hanging from the enclosure forming a heat transfer surface containing the multicomponent working fluid.

In another aspect of the present invention, refractory material lines the first plurality of fluid tubes forming the enclosure.

In still a further aspect of the present invention, a separator receives from the enclosure the flue gases which carry particulate matter, and separates the particulate matter from at least a portion of the flue gases and provides as an output therefrom the at least a portion of the flue gases without the separated particulate matter.

In a further aspect of the present invention, the at least a portion of the flue gases is a first portion of the flue gases and the separator outputs a second portion of the flue gases with the separated particulate matter. A heat exchanger receives the second portion of the flue gases as an output from the separator.

In a still further aspect of the present invention, the separator receives the flue gases with the particulate matter traveling at a first velocity and provides as an output therefrom the second portion of the flue gases with the particulate matter traveling at a second velocity. The second velocity is substantially less than the first velocity.

In a still further aspect of the present invention, the enclosure receives the second portion of the flue gases as an output from the separator. An adjustable flow controller regulates the flow from the separator of the second portion of the gases to the heat exchanger and to the enclosure.

In yet another aspect of the present invention, the heat exchanger includes a third plurality of tubes which transfer heat from the second portion of the flue gases from the separator to the multicomponent working fluid.

In another aspect of the present invention, the heat exchanger includes a fourth plurality of tubes which transfer heat from the second portion of the flue gases from the separator to a single component working fluid. The single component working fluid (e.g., water) is one of a liquid state and a vapor state. Preferably, the fourth plurality of tubes perform one of vaporization and superheating of the single component working fluid.

In another aspect of the present invention, the enclosure contains a fifth plurality of tubes containing a single component working fluid. Typically, this feature would be present in a hybrid power generating system having a Rankine Power cycle and a Kalina power cycle.

According to the present invention, a method is provided for heating a multicomponent working fluid for use in power generation, wherein heat is generated from a circulating fluidized bed configured to a collection of solid particles is combusted producing flue gases, a flow of the flue gases is directed through a chamber formed by a plurality of first fluid tubes, and then the heat from the flue gases is transferred to the multicomponent working fluid in the first fluid tubes. The chamber is formed proximate to the circulating fluidized bed and is configured to receive the flue gases from the circulating fluidized bed. The multicomponent working fluid may be vaporized and superheated. Preferably, the multicomponent working fluid is a mixture of ammonia and water and the circulating fluidized bed operates in a Kalina cycle.

In another aspect of the present invention, the chamber further includes a second plurality of tubes forming a heat transfer surface for receiving the multicomponent working fluid.

In still another aspect of the present invention, the first plurality of fluid tubes forming the chamber are lined with refractory material.

In yet another aspect of the present invention, the flue gases generated in the chamber carry particulate matter, and the flue gases are received from the chamber. The particulate matter of the received flue gases are separated in a separator into a first portion of the flue gases, this first portion being substantially without the particular matter, and a second portion of the flue gases having the particulate matter. The first portion of the flue gases are released to the atmosphere, preferably through a smokestack, or through some other mechanism.

In still another aspect of the present invention, a heat exchanger receives the second portion of the flue gases output from the separator.

In yet another aspect of the present invention, in accordance with the method the chamber receives the second portion of the flue gases as an output from the separator, and regulates the flow of the second portion of the flue gases from the separator to the heat exchanger and to the chamber.

In still another aspect of the present invention, in accordance with the method heat is transferred from the second portion of the flue gases to a multicomponent working fluid contained within a third plurality of tubes of the heat exchanger.

In another aspect of the present invention, in accordance with the method heat is transferred from the second portion of the flue gases to a single component working fluid contained within a fourth plurality of tubes of the heat exchanger.

In yet another aspect of the present invention, in accordance with the method the single component working fluid is vaporized in the fourth plurality of tubes, and the single component working fluid is superheated in the fourth plurality of tubes. Preferably, the single component working fluid is one of a liquid state and a vapor state.

In another aspect of the present invention, in accordance with the method the heat is transferred from the flue gases to a single component working fluid within a plurality of fifth tubes within the chamber.

According to the present invention, a power generating system is provided which includes a vapor generator and one or more turbines. The vapor generator has a circulating fluidized bed configured to combust a collection of solid particles producing flue gases and particulate matter that flow upwardly therewithin. A furnace of the vapor generator forms a chamber configured to contain and direct the flow of the flue gases and the particulate matter. A fluid bed heat exchanger of the vapor generator forms another chamber separate from the furnace chamber but connected to the furnace via a duct through which the flue gases and the particulate matter flow. A plurality of heat transfer surfaces is associated with the fluid bed heat exchanger. At least one of the heat transfer surfaces is configured to have a multicomponent working fluid flow therethrough whereby the multicomponent working fluid absorb heat from the flue gases to produce a vapor for performing work in a power cycle, preferably a Kalina cycle. A turbine of the system expands the vapor to produce mechanical work. The system may have one or more turbines.

In a further aspect of the present invention, a regeneration subsystem receives the expanded vapor from the turbine and condenses the expanded vapor back to the multicomponent working fluid in the form of a liquid.

In another aspect of the present invention, one of the heat transfer surfaces is selected from one of an evaporator and a superheater and a reheater.

In still another aspect of the present invention, at least one of the heat transfer surfaces is configured to carry a single component working fluid.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF THE INVENTION

Figure 1:
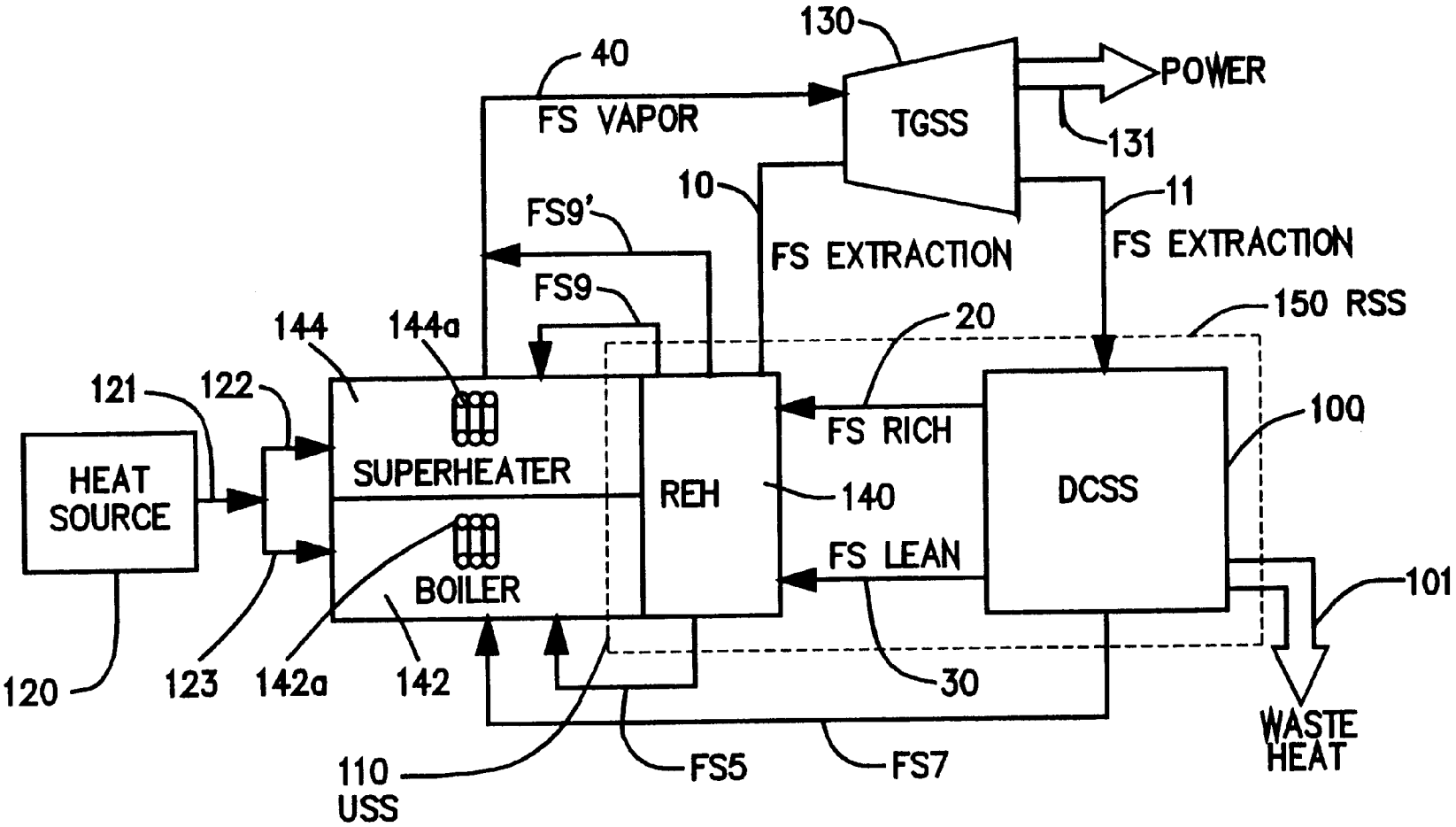
Figure 1 (PRIOR ART)
FIG. 1 is a simplified block diagram of a prior art Kalina cycle system.
Figure 2:
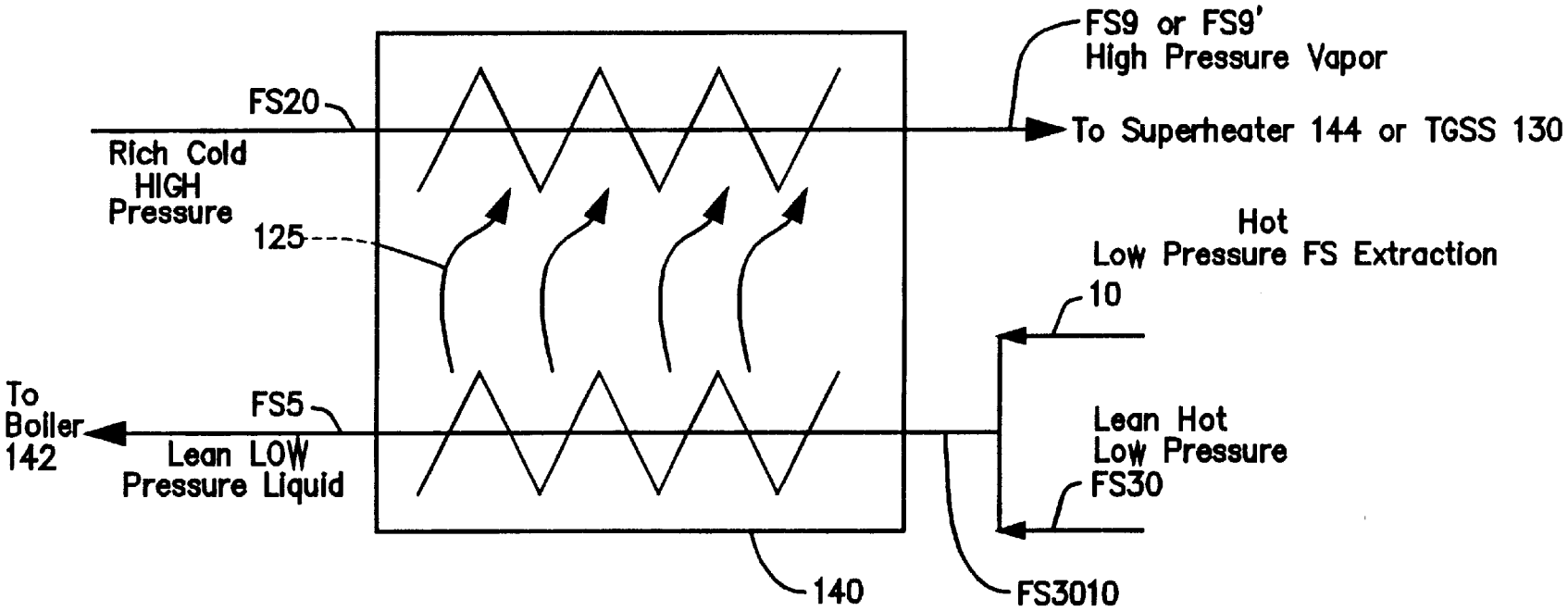
Figure 2 (PRIOR ART)
FIG. 2 is a diagram illustrating the regenerative heat exchanger (RHE) of the conventional Kalina cycle system shown in FIG. 1.
Figure 3:
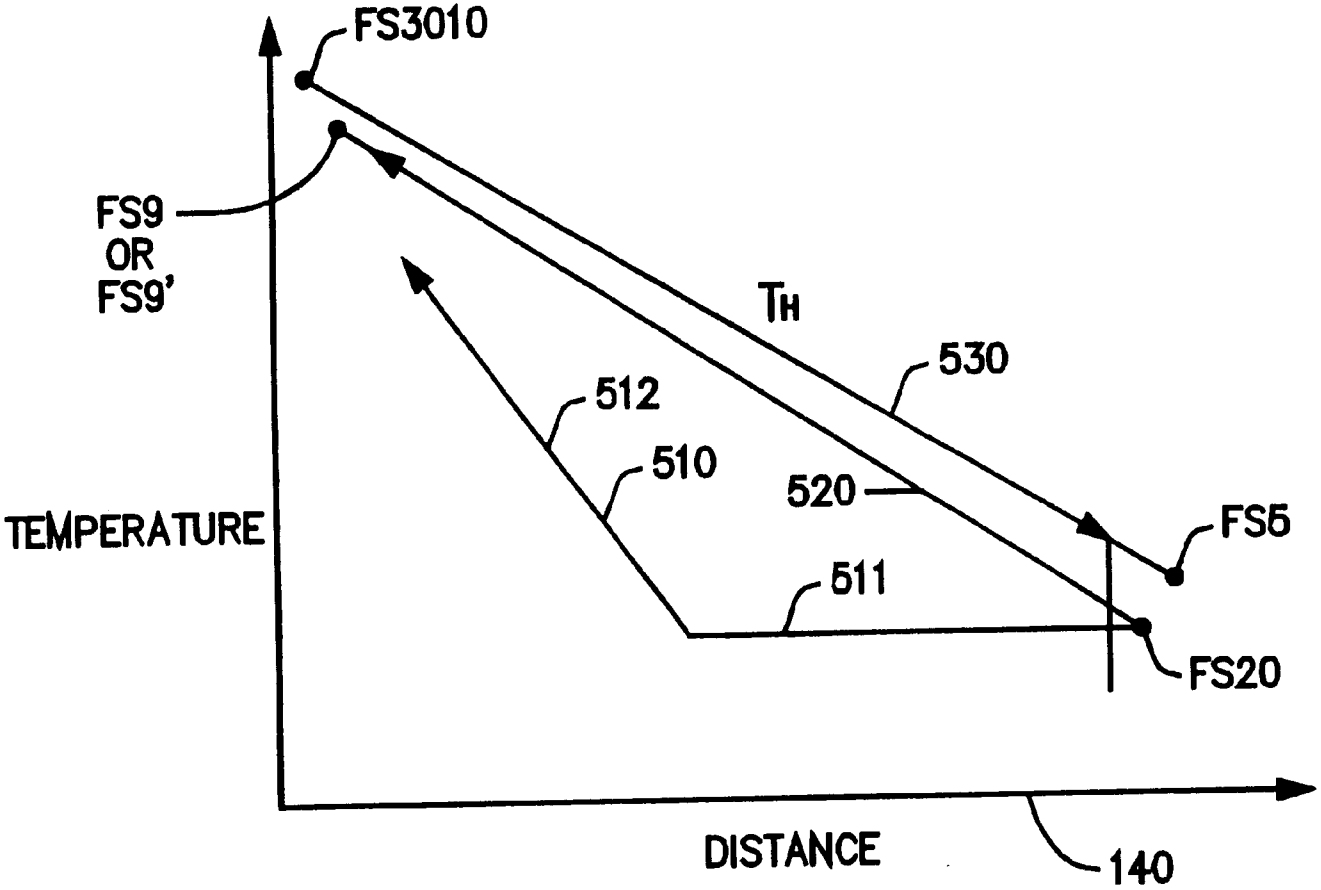
Figure 3 (PRIOR ART)
FIG. 3 is a graph illustrating the basic heat exchange between the flow streams in the RHE of FIG. 2.
Figure 4:
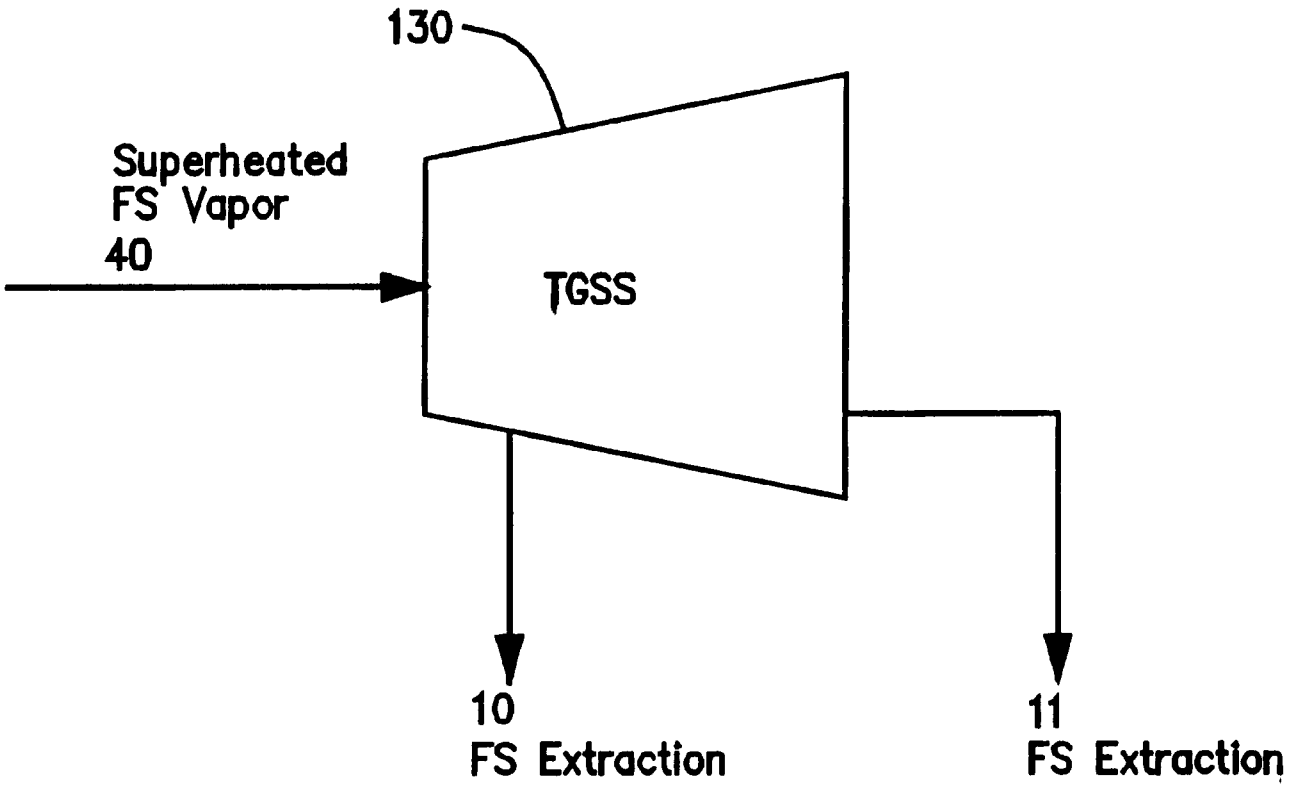
Figure 4 (PRIOR ART)
FIG. 4 is a diagram further detailing the turbine/generator subsystem of the conventional Kalina cycle system shown in FIG. 1.
Figure 5:
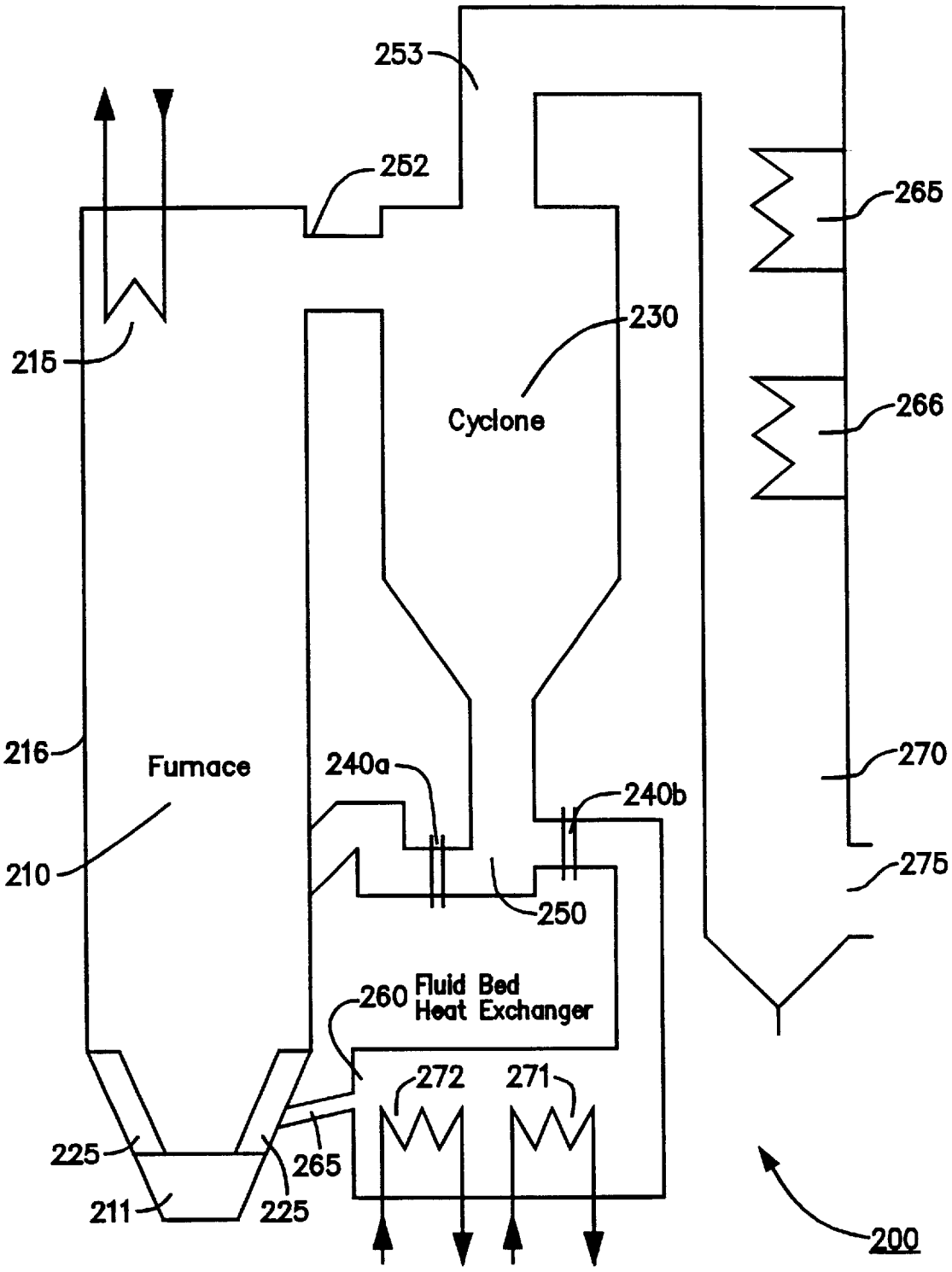
FIG. 5 illustrates a first embodiment of a Kalina cycle power generation system including a circulating fluidized bed system according to the present invention.

FIG. 5 shows an embodiment of a circulating fluidized bed (CFB) system 200 for transferring heat to a multicomponent working fluid, such as the binary ammonia/water working fluid used in Kalina cycle operations. The system 200 includes a circulating fluidized bed combustion chamber 211 which combusts fuel to produce hot gases. The hot gasses, commonly referred to as flue gasses, are directed by the chambers 210, 230, 260 and 270 and the ducts 250, 252, and 253 which connect the chambers. The spent gasses are exhausted from the system via opening 275 to a smokestack (not shown).

The chamber 210, which will be referred to as the furnace, includes fluid tubes 216 which are connected into tubular walls forming a sealed tube wall enclosure and hanging tubes 215. The sealed tube wall enclosure formed by tubes 216 directs the flue gasses produced in the circulating fluidized bed combustion chamber 211, while, during normal operations, each of the tubes 216 at the same time directs a flow of the working fluid along a path so that heat is transferred from the flue gasses to the working fluid flowing within the tubes 216. As will be recognized by those skilled in the art, the tubes 216 serve as a boiler for evaporating, i.e., vaporizing, the working fluid. The additional fluid tubes 215, as shown, form a primary superheater within the enclosure formed by the tubes 216.

Chamber 270, which will be referred to as the furnace backpass, includes fluid tubes 265 forming a heat exchanger which receives vaporized working fluid from the tubes 216. The vaporized working fluid within the tubes 265 is superheated to some extent by the gasses flowing through chamber 270 prior to being directed by the tubes 265 to the primary superheater formed by tubes 215. The chamber 270 also includes tubes 266 forming another heat exchanger, commonly referred to as a reheater. The tubes 266 receive expanded vaporized working fluid from a turbine, such as an HP turbine (not shown). The expanded working fluid within the tubes 266 is reheated by the gasses flowing in chamber 270 prior to being directed by the tubes 266 to another turbine, such as an IP or LP turbine (not shown).

The chamber 260, which will be referred to as a fluid bed heat exchanger, includes tubes 271 and 272, each forming a respective heat exchange element for receiving, as shown, a working fluid received from outside system 200. For example, the working fluid might be received from a regenerative heat exchanger (RHE) and/or distillation and condensation subsystem (DCSS) of the type typically found in a Kalina cycle power generation system. The working fluid might alternatively or additionally be expanded working fluid received from a turbine, in which case the heat exchanger serves as a reheater. The received working fluid flowing within the tubes 271 and 272 is vaporized and/or superheated or reheated by the gases being directed from the chamber 260. The working fluid may be a multicomponent working fluid of the type heated in the furnace and furnace backpass, or could, if desired, be some other type of working fluid, such as a some other type of multicomponent working fluid or a single component working fluid, e.g., water. The working fluid within the tubes 271 and 272 is vaporized and/or superheated or reheated prior to being directed by the tubes 271 and 272 from the system 200. For example, the vaporized/superheated or reheated working fluid could be directed to an RHE or DCSS of the type discussed above and used to vaporize multicomponent working fluid of the type flowing within the fluid tubes 215, 216, 265 and 266.

The circulating fluidized bed combustor 211 operates such that a fluidized bed of particulate fuel, such as pulverized coal, is, as noted above, combusted to produce hot flue gases at approximately 1600° F. This should be contrasted with the temperatures of flue gases produced in direct fired burner type furnaces which are typically in the range of 2800° F.–3000° F. These high temperatures will have a detrimental effect on the longevity of fluid tubes cooled by multicomponent fluids, such as those used in Kalina cycle power generation systems. Hence, the tube life can be prolonged by generating process heat using a CFB rather than direct fired burner type furnaces.

The combustion of the coal by the CFB combustor 211 also produces a relatively substantial amount of particulate matter which is intermixed with the flue gasses flowing in the furnace. The flue gasses move at a high velocity, a typical velocity being 20 ft/sec, through the furnace chamber 210 and furnace output duct 252. The lower portion of the fluid walls formed by tubes 216 are covered with refractory material 225 to protect the tubes such as, for example, against radiant heat and erosion damage which might otherwise be caused by the fast moving, typically still burning, particulate matter which flows through the lower portion of the furnace chamber 210 with the high velocity flue gasses from the CFB combustor 211.

A cyclone separator 230 receives the high velocity flue gases and particulate matter from the furnace chamber 210 via duct 252. The received flow is preferably at a temperature of approximately 1600° F. The cyclone separator 230 separates out the particulate matter from a portion of the flue gasses. This portion of the flue gasses, which is now preferably at a temperature within the range of from 1500° F. to 1600° F., is directed via duct 253 to the furnace backpass chamber 270. It should be recognized that, if desired, the particulate matter could be completely removed from the flue gasses in the separator 230. In such a case, the particulate matter would be collected from the bottom of the separator and all the flue gasses could be directed to the furnace backpass chamber 270.

A mixture of the remainder of the flue gases and the particulate matter are directed by the cyclone separator 230 to the duct 250. The cyclone separator 230 significantly slows the flow of the mixture of flue gases and particulate matter directed to the duct 250 so that the velocity of the mixture in the chamber 260 is 3–4 feet/sec. and thus much slower than the mixture of flue gases and particular matter flowing through the furnace chamber 210. Because of the lower velocity of the mixture, the fluid tubes 271 and 272 can be exposed to the high particulate matter mixture without incurring substantial erosion damage to the tube surfaces.

The duct 250 opens into the furnace chamber 210 and heat exchange chamber 260. Flow control dampers 240*a* and 240*b* are included to control the flow of the mixture to the respective chambers 210 and 260. More particularly, the dampers 240*a* and 240*b* can be operated such that all of the mixture flows reenters chamber 210, i.e., with damper 240*b* fully closed, or all of the mixture flows to the heat exchange chamber 260, i.e., with damper 240*a* fully closed, or the flow of the mixture is split and any desired ratio between chambers 210 and 260, i.e., by opening both damper 240*a* and damper 240*b* an appropriate amount. The portion of the mixture directed through duct 250 back to chamber 210 is used to further heat the working fluid flowing through tubes 215 and 216. The portion of the mixture directed through duct 250 to heat exchange chamber 260 is used to heat the working fluid flowing through tubes 271 and 272, as previously described.

For example, during startup operations of the CFB system 200, dampers 240*a* and 240*b* can be used to regulate the influx of heat into the fluid bed heat exchanger 260. More particularly, during initiation of operations of system 200 damper 240*b* is preferably closed so that all of the flue gases entering duct 250 flow back to the furnace chamber 210 and are recirculated through the furnace to provide additional evaporative or superheat duty to the working fluid flowing in tubes 215 and 216.

After some initial period of the start-up operations, the damper 240*b* is opened to some extent. Damper 240*a* may be closed to some extent at the same time, although this is not mandatory. This allows the fluid bed exchanger 260 to begin receiving the hot mixture of flue gasses and particulate matter from the duct 250. By carefully setting the flow ratio with the dampers 240*a* and 240*b*, the mixture flowing from duct 250 to the heat exchanger 260 will heat the tubes 271 and 272 over time. Because of the controlled heating of the exchanger damage to the heat transfer surfaces of the tubes 271 and 272, which might otherwise occur, is avoided. This might be particularly important when multicomponent working fluid is cooling the tubes 271 and 272. Further still, if additional evaporative or superheat duty is needed for a particular cycle design, say during start-up or shut-down, it could, if desired, be provided in the fluid bed heat exchanger 260 as necessary. Thus, system 200 provides enhanced start-up and shutdown operational control.

The mixture of flue gasses and particulate matter egressing from the heat exchanger 260 is directed by duct 265 back to the lower portion of the furnace chamber 210 where particulate matter within the mixture can be reignited by the burning particulate matter rising from the CFB, thereby undergoing further combustion and generating further heat which will be transferred to the working fluid(s) in the fluid tubes of the various chambers.

Hence using a circulating fluid bed (CFB) 211 in combination with a fluid bed heat exchanger 260 as described above, results in heat fluxes which are more tolerable to systems utilizing multi-component working fluids, such as ammonia/water binary working fluids used in a Kalina cycle, as the cooling medium.

Figure 6:
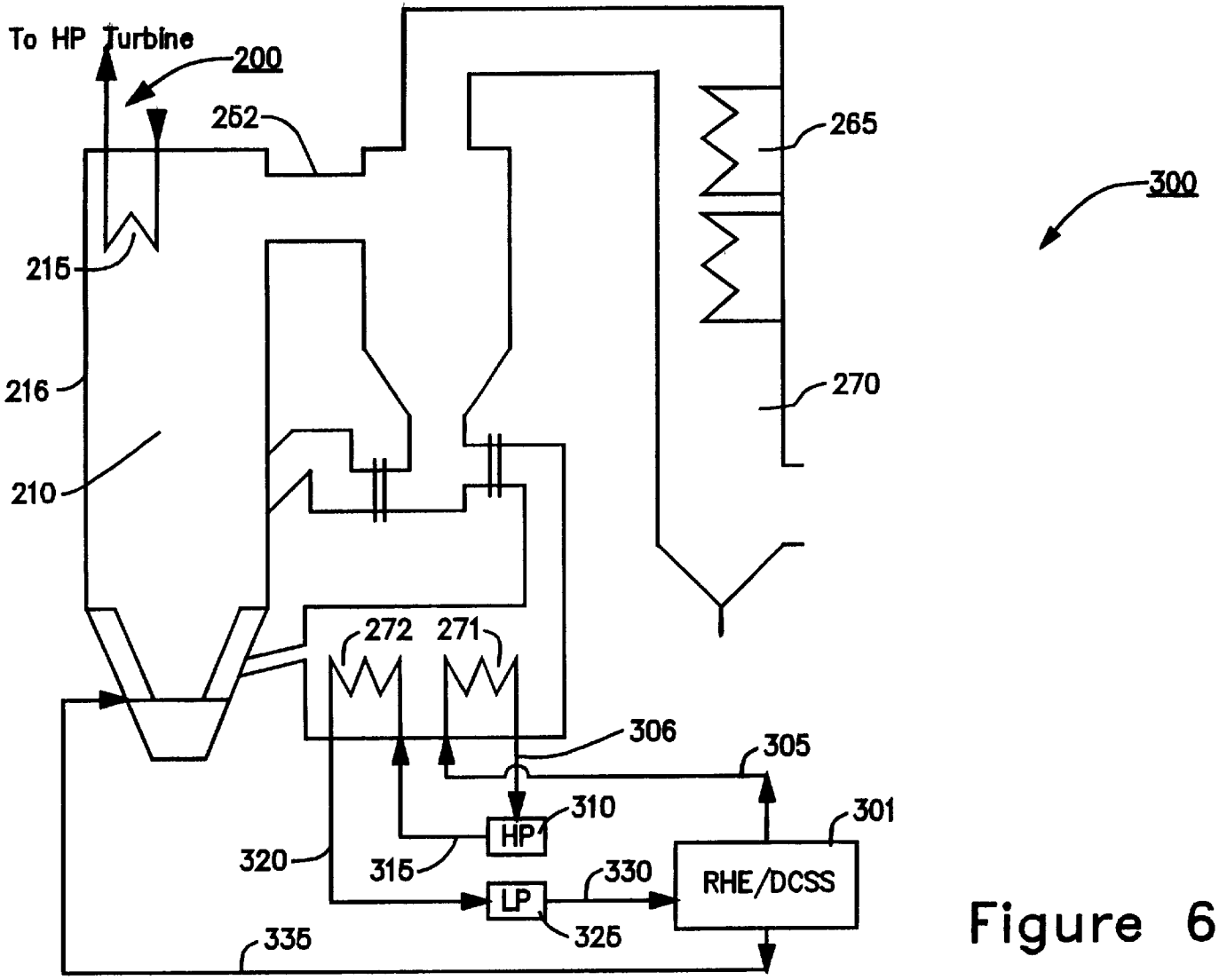
FIG. 6 illustrates a second embodiment of a Kalina cycle power generation system including a circulating fluidized bed according to the present invention.

FIG. 6 shows an embodiment of a Kalina cycle power generation system 300 including the circulating fluidized bed (CFB) system 200 as a component for heating a multicomponent working fluid, such as the binary working fluid used in a Kalina cycle, i.e., a mixture of ammonia and water. Although the system 300 will be described below in an implementation using a Kalina cycle, it should be recognized that the working fluid could be a mixture of chemicals or chemical compounds other than water and ammonia.

A working fluid stream 335 enters the furnace 210 from the RHE/DCSS 301, discussed in the background, and is vaporized in the boiler tubes 216, initially superheated in the fluid tubes 265 located in the furnace backpass 270 and finally superheated by superheater tubes 215. The superheated binary working fluid which is provided as an output from the superheater tubes 215 is directed to the high pressure (HP) turbine 310.

Another working fluid stream 305 enters the fluid bed heat exchanger 260 from the RHE/DCSS 301. The stream 305 has already been vaporized in the RHE/DCSS 301 and is superheated in the fluid tubes 271 which form one of the heat exchange elements of the heat exchanger 260. The superheated binary vapor stream 306 is provided as an output to the HP turbine 310 where it is used to perform useful work. Typically the output from the superheater tubes 215 and the stream 306 are combined upstream of the HP turbine 310.

The fluid bed heat exchanger 260 also includes a reheater section formed of tubes 272 which reheats an expanded vapor working fluid which is provided as an output from the HP turbine 310 as stream 315. The working fluid which is provided as an output from the exchanger 260 as reheated stream 320 is directed to the low pressure (LP) turbine 325, where it is used to perform useful work. It will be recognized that an intermediate pressure (IP) turbine could, if desired, be substituted for the LP turbine 325. The exhausted working fluid is provided as an output from the LP turbine as stream 330 to the RHE/DCSS 301. The DCSS of the RHE/DCSS 301 may, for example, condense vapor in the working fluid stream 330 back to a liquid state. All or part of this liquid working fluid may be provided as an output to the RHE of the RHE/DCSS 301 where it can be vaporized and used to form all or part of the working fluid stream 305 and/or to the furnace 210 and can be used to form part of the feed liquid working fluid stream 335.

Figure 7:
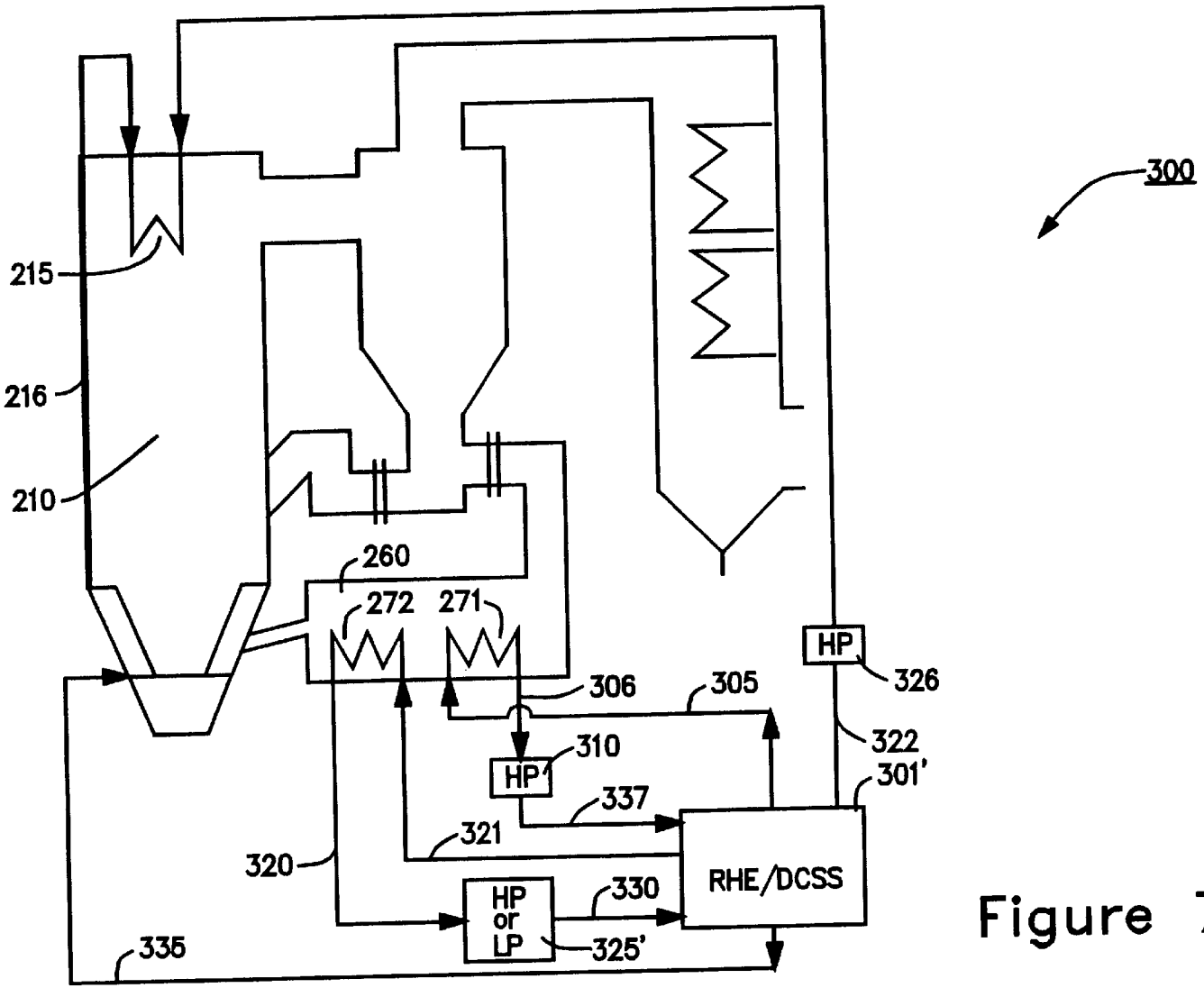
FIG. 7 illustrates a third embodiment of a hybrid cycle power generation system including a circulating fluidized bed according to the present invention.

FIG. 7 shows an third embodiment of a hybrid Kalina cycle power generation system 300 including the circulating fluidized bed (CFB) system 200. The third embodiment includes two Rankine power cycles, one using the heat exchanger 272 and the other using the superheater 215, and a Kalina power cycle using the heat exchanger 271.

In the Rankine power cycle, a single component working fluid stream 335, typically water, enters the furnace 210 from the RHE/DCSS 301' and is vaporized in the boiler tubes 216 and superheated by superheater tubes 215. The superheated working fluid output from the superheater tubes 215 is directed to the high pressure (HP) turbine 326 and the expanded vapor stream 322 is reintroduced into the RHE/DCSS 301'. The RHE/DCSS 301 of FIG. 6 has been modified to produce the RHE/DCSS 301' employed for hybrid application. In the RHE/DCSS 301', the Rankine power cycle may share one or more components of the RHE/DCSS 301' with the Kalina power cycle, such as the cooling system. In RHE/DCSS 301', the expanded vapor 322 is condensed back to liquid form.

In the Kalina power cycle, a binary working fluid stream 305, typically ammonia/water, enters fluid bed heat exchanger 260 from the RHE/DCSS 301'. The stream 305 has already been vaporized in the RHE/DCSS 301' and is superheated in the fluid tubes 271 which form one of the heat exchange elements of the heat exchanger 260. The superheated binary vapor stream 306 is provided as an output to the HP turbine 310 where it expands while performing useful work. The expanded stream 337 returns back to the RHE/DCSS 301' completing the cycle.

In another Rankine power cycle, a single component working fluid stream 321, typically water, enters fluid bed heat exchanger 260 from the RHE/DCSS 301'. The stream 321 from the RHE/DCSS 301' is superheated in the fluid tubes 272 which forms one of the heat exchange elements of the heat exchanger 260. The superheated binary vapor stream 320 is output to the HP or LP turbine 325' where it expands while performing useful work. The expanded stream 330 returns to the RHE/DCSS 301' completing the cycle.

Although FIGS. 5,6, 7 illustrate particular embodiments of the use of a CFB system with a multicomponent working fluid, such as a binary working fluid of the type used in a Kalina cycle, other embodiments may be configured, having one or more heat exchange elements in the furnace (e.g., heat exchange elements 215, 216), one or more heat exchange elements in the fluid bed heat exchanger (e.g., 271, 272), or one or more heat exchange elements in the furnace backpass 270 (e.g., 265, 266). These heat exchange elements may be evaporators, superheaters, or reheaters, or any desired combination thereof. These heat exchange elements may be connected in various combinations with one or more turbines and with one or more heat transfer devices, such as an RHE/DCSS, to implement a particular circuit arrangement to perform work. Another embodiment of the hybrid system of FIG. 7 may have only one of the Rankine cycles. Other embodiments of a hybrid system could allocate in any combination the heat exchange elements of the furnace, fluid bed heat exchanger, and backpass to multicomponent power cycles and single component power cycles.

Accordingly, the above described embodiments and other similar embodiments of a CFB system including a circulating fluidized bed, an external fluidized bed heat exchanger including heat exchange elements for carrying a multicomponent fluid produces a system having the following advantages: (1) since combustion temperatures of a circulating fluidized bed are low, peak heat fluxes are significantly lower than in a conventional combustion system, consequently reducing the presence of high radiant heat conditions; (2) startup may be more easily dealt with by suitable design of circuitry to and/or the external fluidized bed heat exchanger, for example, an evaporative and/or superheat section could be included in the external fluidized bed exchanger to produce vapor or superheated vapor early in the startup cycle, with this section(s) being shut off if not desired at higher loads, (3) the flexibility of the circulating fluidized bed system allows better integration and optimization of a Kalina cycle, (4) the use of the CFB allows a binary fluid stream to be used to cool the furnace walls without the need for complicated parallel duties, (5) having a refractory lined lower furnace and lower heat flux to the furnace walls, allows for easier start up and operation with working fluids which require reduced evaporative duty, and (6) the reduced heat flux to the furnace walls allows for lower cost materials to be used to form the fluid tubes and could reduce the need for protective coating on the fluid tubes.

What is claimed is:

1. An apparatus for heating a multicomponent working fluid, comprising:

a circulating fluidized bed configured to combust a collection of solid particles producing flue gases; and a first plurality of fluid tubes forming an enclosure for containing and directing a flow of the flue gases configured to direct a flow of the multicomponent working fluid so that heat from the flue gases is transferred to the multicomponent working fluid.

2. The apparatus of claim 1, wherein:

the first plurality of fluid tubes are further configured such that the heat transferred from the flue gases performs vaporizing and superheating of the multicomponent working fluid.

3. The apparatus of claim 1, wherein:

the multicomponent working fluid is a mixture of ammonia and water.

4. The apparatus of claim 1, wherein:

the apparatus operates in a Kalina cycle.

5. The apparatus of claim 1, wherein:

the enclosure is formed proximate to the circulating fluidized bed for receiving the flue gases from the circulating fluidized bed.

6. The apparatus of claim 1, wherein:

the enclosure further includes a second plurality of tubes hanging from the enclosure forming a heat transfer surface containing the multicomponent working fluid.

7. The apparatus of claim 1, further comprising:

refractory material configured to line the plurality of first tubes forming the enclosure.

8. The apparatus of claim 1, wherein the flue gases directed by the enclosure carry particulate matter, further comprising:

a separator configured to receive the flue gases from the enclosure, to separate the particulate matter from at least a portion of the flue gases and to provide as an output the at least a portion of the flue gases substantially without the separated particulate matter.

9. The apparatus of claim 8, wherein:

the at least a portion of the flue gases is a first portion of the flue gases and the separator is configured to provide as an output therefrom a second portion of the flue gases with the separated particulate matter, and further comprising:

a heat exchanger configured to receive the second portion of the flue gases provided as an output from the separator.

10. The apparatus of claim 9, wherein:

the separator receives the flue gases with the particulate matter traveling at a first velocity and provides as an output therefrom the second portion of the flue gases with the particulate matter traveling at a second velocity, the second velocity being substantially less than the first velocity.

11. The apparatus of claim 9, wherein the enclosure is further configured to receive the second portion of the flue gases as an output from the separator, and an adjustable flow controller is configured to regulate the flow from the separator of the second portion of the gases to the heat exchanger and to the enclosure.

12. The apparatus of claim 9, wherein:

the heat exchanger includes a third plurality of tubes configured to transfer heat from the second portion of the flue gases from the separator to the multicomponent working fluid.

13. The apparatus of claim 9, wherein:

the heat exchanger includes a fourth plurality of tubes configured to transfer heat from the second portion of the flue gases from the separator to a single component working fluid.

14. The apparatus of claim 13, wherein the fourth plurality of tubes perform one of vaporization and superheating of the single component working fluid.

15. The apparatus of claim 14, wherein the single component working fluid is one of a liquid state and a vapor state.

16. The apparatus of claim 1, further comprising the step of:

transferring the heat from the flue gases to a single component working fluid within a fifth plurality of tubes within the enclosure.

17. A method for heating a multicomponent working fluid for use in power generation, comprising the steps of:

generating heat from a circulating fluidized bed configured to combust a collection of solid particles producing flue gases;

directing a flow of the flue gases through a chamber formed by a first plurality of fluid tubes; and transferring the heat from the flue gases to the multicomponent working fluid in the first plurality of fluid tubes.

18. The method for heating a multicomponent working fluid for use in power generation of claim 17, wherein:

the transferring step, further comprises:

vaporizing the multicomponent working fluid with the heat; and superheating the multicomponent working fluid with the heat.

19. The method for heating a multicomponent working fluid for use in power generation of claim 17, wherein:

the multicomponent working fluid is a mixture of ammonia and water.

20. The method for heating a multicomponent working fluid for use in power generation of claim 17, wherein:

the apparatus operates in a Kalina cycle.

21. The method for heating a multicomponent working fluid for use in power generation of claim 17, wherein:

the chamber is formed proximate to the circulating fluidized bed and is configured to receive the flue gases from the circulating fluidized bed.

22. The method for heating a multicomponent working fluid for use in power generation of claim 21, wherein:

the chamber further includes a second plurality of tubes forming a heat transfer surface for receiving the multicomponent working fluid.

23. The method for heating a multicomponent working fluid for use in power generation of claim 22, further comprising the step of:

lining the plurality of first fluid tubes forming the chamber with refractory material.

24. The method for heating a multicomponent working fluid for use in power generation of claim 17, wherein:

the flue gases directed by the chamber carry particulate matter, further comprising the steps of:

receiving the flue gases from the chamber;

separating in a separator the particulate matter of the flue gases received from the chamber into a first portion of the flue gases, the first portion being substantially without particular matter, and a second portion of the flue gases being particulate matter; and releasing the first portion of the flue gases to the atmosphere.

25. The method for heating a multicomponent working fluid for use in power generation of claim 24, further comprising the step of:

receiving in a heat exchanger the second portion of the flue gases provided as an output from the separator.

26. The method for heating a multicomponent working fluid for use in power generation of claim 25, further comprising the steps of:

receiving in the chamber the second portion of the flue gases provided as an from the separator; and regulating the flow from the separator of the second portion of the gases to the heat exchanger and to the chamber.

27. The method for heating a multicomponent working fluid for use in power generation of claim 26, further comprising the step of:

transferring heat from the second portion of the flue gases from the separator to a multicomponent working fluid contained within a third plurality of tubes of the heat exchanger.

28. The method for heating a multicomponent working fluid for use in power generation of claim 27, further comprising the step of:

transferring heat from the second portion of the flue gases from the separator to a single component working fluid contained within a fourth plurality of tubes of the heat exchanger.

29. The method for heating a multicomponent working fluid for use in power generation of claim 28, wherein the transferring step further comprises the steps of:

vaporizing the single component working fluid in the fourth plurality of tubes; and superheating the single component working fluid in the fourth plurality of tubes.

30. The method for heating a multicomponent working fluid for use in power generation of claim 29, wherein the single component working fluid is one of a liquid state and a vapor state.

31. The method for heating a multicomponent working fluid for use in power generation of claim 17, further comprising the step of:

transferring the heat from the flue gases to a single component working fluid within a plurality of fifth tubes within the chamber.

32. A power generating system, comprising:

a vapor generator, comprising:

a circulating fluidized bed configured to combust a collection of solid particles producing flue gases and particulate matter flowing upwardly therewithin;

a furnace forming a chamber configured to contain and direct the flow of the flue gases and the particulate matter;

a fluid bed heat exchanger forming another chamber separate from the furnace chamber but connected to the furnace via a duct through which the flue gases and the particulate matter flow;

a plurality of heat transfer surfaces associated with the fluid bed heat exchanger, at least one of the heat transfer surface configured to carry a multicomponent working fluid, the multicomponent working fluid absorbing heat from the flue gases to produce a vapor for performing work in a power cycle; and a turbine configured to expand the vapor to produce mechanical work.

33. The power generating system of claim 32, further comprising:

a regeneration subsystem receiving the expanded vapor from the turbine and condensing the expanded vapor back to the multicomponent working fluid in the form of a liquid.

34. The power generating system of claim 32, wherein:

the multicomponent working fluid is a mixture of ammonia and water.

35. The power generating system of claim 32, wherein:

the power cycle is a Kalina cycle.

36. The power generating system of claim 32, wherein:

one of the heat transfer surfaces is selected from one of an evaporator and a superheater and a reheater.

37. The power generating system of claim 32, wherein:

at least one of the heat transfer surfaces is configured to carry a single component working fluid.

38. A system for heating working fluids, comprising:

a separator configured to receive flue gases having particulate matter, and to separate particulate matter from the received flue gases to form (i) a first portion of the flue gases substantially free of the separated particulate matter and (ii) a second portion of the flue gases with the separated particulate matter;

a first plurality of tubes configured to transfer heat from the second portion of the flue gases to a multicomponent working fluid; and a second plurality of tubes configured to transfer heat from the second portion of the flue gases to a single component working fluid.

39. An method for heating working fluids, comprising:

receiving flue gases having particulate matter;

separating the particulate matter from the received flue gases to form a first portion of the flue gases substantially free of the separated particulate matter and a second portion of the flue gases with the separated particulate matter;

transferring heat from the second portion of the flue gases to a multicomponent working fluid; and transferring heat from the second portion of the flue gases to a single component working fluid.

40. An apparatus according to claim 1, wherein the first plurality of fluid tubes forming the enclosure is further configured to output the flue gases after transferring the heat from the flue gases to the multicomponent working fluid, and further comprising:

a heat exchanger;

a first damper configured to regulate the flow of a first portion of the output flue gases to the heat exchanger; and a second damper configured to regulate a second portion of the output flue gases back to the enclosure.

41. A method according to claim 17, further comprising the steps of:

outputting the flue gases from the chamber after the transfer of the heat from the flue gases to the multicomponent working fluid; and regulating the flow of a first portion of the output flue gases to a heat exchanger and a second portion of the output flue gases back to the chamber.

42. An apparatus according to claim 32, wherein the furnace is further configured to output the directed flow of flue gases, and further comprising:

a first damper configured to regulate the flow of a first portion of the output flue gases back to the furnace; and a second damper configured to regulate the flow of a second portion of the output flue gasses to the fluid bed exchanger.

* * * * *